US008465804B2

(12) United States Patent
Provoost et al.

(10) Patent No.: US 8,465,804 B2
(45) Date of Patent: Jun. 18, 2013

(54) METHOD FOR MANUFACTURING COATED PANELS

(75) Inventors: Peter Provoost, Roeselare (BE); Bart Verhaeghe, Dranouter (BE)

(73) Assignee: Flooring Industries Limited, SARL, Bertrange (LU)

( * ) Notice: Subject to any disclaimer, the term of this patent is extended or adjusted under 35 U.S.C. 154(b) by 748 days.

(21) Appl. No.: 12/404,070

(22) Filed: Mar. 13, 2009

(65) Prior Publication Data

US 2009/0252925 A1 Oct. 8, 2009

(30) Foreign Application Priority Data

Apr. 8, 2008 (EP) ..... 08006954

(51) Int. Cl.
*B05D 1/36* (2006.01)
*B05D 5/00* (2006.01)

(52) U.S. Cl.
USPC ..... 427/265; 427/258; 427/261; 427/267

(58) Field of Classification Search
USPC ..... 427/258, 261, 265, 267
See application file for complete search history.

(56) References Cited

U.S. PATENT DOCUMENTS

| | | | | |
|---|---|---|---|---|
| 3,173,804 | A | 3/1965 | Standfuss | |
| 3,554,827 | A | 1/1971 | Yamagishi | |
| 3,810,774 | A * | 5/1974 | Pittman | 428/151 |
| 3,811,915 | A | 5/1974 | Burrell et al. | |
| 3,905,849 | A | 9/1975 | Bomboire | |
| 4,050,409 | A | 9/1977 | Duchenaud et al. | |
| 4,097,635 | A * | 6/1978 | Sanz Hernandez et al. | 428/172 |
| 4,233,343 | A * | 11/1980 | Barker et al. | 427/264 |
| 5,082,495 | A * | 1/1992 | Iijima | 106/31.16 |
| 6,477,948 | B1 * | 11/2002 | Nissing et al. | 101/211 |
| 6,979,487 | B2 * | 12/2005 | Scarbrough et al. | 428/195.1 |
| 6,991,830 | B1 * | 1/2006 | Hansson et al. | 427/504 |
| 2004/0026017 | A1 | 2/2004 | Taylor et al. | |

FOREIGN PATENT DOCUMENTS

| | | | |
|---|---|---|---|
| EP | 1 872 959 | A1 | 1/2008 |
| FR | 2 827 529 | A1 | 1/2003 |
| WO | WO 97/47834 | | 12/1997 |
| WO | WO 01/47725 | A1 | 7/2001 |
| WO | WO 01/48333 | A1 | 7/2001 |
| WO | WO 2004/042168 | A1 | 5/2004 |

* cited by examiner

*Primary Examiner* — Frederick Parker
(74) *Attorney, Agent, or Firm* — Capitol City TechLaw

(57) ABSTRACT

A coated panel may include a substrate and a decorative top layer provided on the substrate. A method for manufacturing the panel may involve forming at least a portion of the top layer by printing on the substrate to provide a structure on the substrate. The structure may include protrusions formed by two or more prints provided on top of each other.

13 Claims, 2 Drawing Sheets

METHOD FOR MANUFACTURING COATED PANELS

PRIORITY STATEMENT

This US non-provisional application claims priority under 35 USC §119 to European Patent Application No. 08006954.5 filed Apr. 8, 2008, the content of which is incorporated herein in its entirety by reference.

BACKGROUND

1. Field of the invention

In general, the invention relates to a method for manufacturing coated panels, as well as to coated panels. More particularly, the invention relates to a method for manufacturing panels of the type comprising at least a substrate and a decorative top layer provided on this substrate, wherein the method, in order to form at least a portion of the top layer, comprises a step in which the substrate is printed, whether or not by the intermediary of possible primer layers or other intermediate material, in particular intermediate material layers.

2. Description of Related Art

Panels are known, for example, from the patent documents U.S. Pat. No. 3,173,804, U.S. Pat. No. 3,554,827, U.S. Pat. No. 3,811,915, WO 01/48333, WO 01/47724, US 2004/026017, WO 2004/042168 and EP 1 872 959.

From the aforesaid patent documents, various methods are known for providing the surface of the panel with a structure. From WO 2004/042168, it is known to provide recesses in the substrate itself or in a primer layer and to perform a print on this structured substrate. From WO 01/47725, U.S. Pat. No. 3,811,915 and U.S. Pat. No. 3,554,827, it is known to provide a lacquer-repelling agent on the print, such that the transparent lacquer layer subsequently provided thereon hardens selectively, such that a structure is formed on the final panel. From WO 01/48333, it is known to provide, by means of a mould or pressing roller, impressions in a lacquer layer provided on top of the print. From WO 01/47724, it is known to provide a transparent lacquer layer by means of an inkjet selectively on top of the actual print and to realize a structure in this manner.

Each of the known techniques for realizing a structure requires a high accuracy when a certain degree of correspondence between the actual print and the structure has to be obtained. Moreover, the above-mentioned techniques leave much to be desired in respect to flexibility and/or in respect to feasible structures. Thus, for example, it is difficult to realize structures with acute angles by these techniques. The relatively strongly rounded portions, which are difficult to avoid in the state of the art, lead to an unnatural appearance of the respective structure. Also, obtaining deep structures is not simple with the known techniques.

SUMMARY

The present invention aims at an alternative method for manufacturing coated panels of the above-mentioned type and, according to various embodiments thereof, offers advantages in respect to the state of the art. To this aim, the invention relates to a method for manufacturing coated panels of the type comprising at least a substrate and a decorative top layer provided on this substrate, wherein the method, in order to form at least a portion of said top layer, comprises a step in which the substrate is printed, with the characteristic that during said step a structure is realized on the substrate, wherein said structure comprises protrusions which are formed by two or more prints or print layers provided on top of each other.

Due to the fact that at least two prints or print layers are provided on top of each other, a level variance may be created in the top layer, whereby more complex and/or more pronounced structures can be obtained. Preferably, protrusions are used which are formed with 3 or more, for example, up to 10 prints provided on top of each other, which considerably enhances the depth resolution, while still obtaining an economical process. Of course, not necessarily all protrusions of the respective structure must be constructed of an equally high number of prints or print layers provided on top of each other. By varying the number of prints provided on top of each other depending on the protrusion, a larger variation in the respective structure may be obtained.

It is noted that said protrusions can manifest themselves locally as well as rather relatively extended. It is possible that a protrusion substantially extends over the entire surface of the substrate and is interrupted at one or more locations only, such that it is rather the interruption that provides for said structure.

According to a first embodiment, two or more prints or print layers provided on top of each other show an identical pattern in a cross-section of the respective protrusion. By this, it is meant that the respective protrusion, viewed in a local cross-section, consists of two or more prints or print layers covering each other substantially or even almost perfectly. This embodiment allows performing relatively large level variances, wherein the respective protrusion, at least in the respective cross-section, possibly may be provided with straight walls or relatively acute angles. Still better, the respective protrusion, for the major part thereof, has cross-sections in which said print layers cover each other substantially or even almost perfectly.

According to a second embodiment, two or more prints or print layers provided on top of each other show a different pattern in a cross-section of the respective protrusion, wherein the print located on top preferably has a smaller printed surface. This means that, in the case of a smaller printed surface, the respective protrusion, viewed in a local cross-section, consists of two or more prints or print layers, which do not cover each other entirely. This preferred embodiment allows realizing protrusions with an inclined wall, which as such increases the number of possibly achievable structures. Still better, the respective protrusion, for the major part thereof, has cross-sections in which the print layers show a different pattern, in other words, a different printed surface. It is clear that according to another possible embodiment of this second embodiment, the print or print layer lying on top may have a larger printed surface, as a result of which the underlying print layer possibly may be covered entirely.

Of course, the above two embodiments may be combined in the same coated panel or even in the same protrusion. By this is meant that the structure may be constructed by means of one or more protrusions having cross-sections with the features of the first embodiment, as well as cross-sections with the features of the second embodiment.

The two or more prints or print layers provided on top of each other may be made of the same material. By this, it is obtained that the respective protrusion is homogeneously constructed. However, it is not excluded that the material in certain print layers is varied, for example, with the intention of obtaining a visible layer structure or a visible gradual color and/or tint variation in the respective protrusion.

The method of the invention may be implemented to manufacture panels with a decorative top layer representing a wood pattern, wherein the structure then relates to a wood structure. Of course, one may also work with stone patterns, fantasy patterns and respective structures. Still better, the structure may correspond to an underlying, also printed pattern, for example, to the aforementioned wood pattern.

The step in which the substrate is printed may be performed by means of one or more digitally controlled inkjet printing units. The use of inkjet printing units for printing on substrates of panels is known as such, for example, from the already mentioned WO 01/48333 and EP 1 872 959. The inventors have found that the use of digitally controlled printing units is advantageous with the method of the present invention, as they allow a precise and repeatable printing, such that the various print layers, if necessary, can be applied perfectly on top of each other or can be aligned in mutual respect. It is noted that, according to the state of the art, never overlapping print layers have been formed by inkjet printing units, the print layers forming a structure of protrusions, but that, if several of such printing units were applied, these finally resulted in a flat print. According to the present invention, the structure variation obtained by the overlapping prints is present in the print of the final coated panels. The obtained structure is noticeably present at the surface of the coated panel, although this is not necessarily so.

The method may comprise a step in which the substrate is provided with a transparent or translucent layer, which is provided on top of the prints. Although it is not excluded that, by means of the transparent or translucent layer, finally a flat surface is obtained, preferably at least a portion of the already formed protrusions, or even all of the protrusions, manifest themselves through the transparent or translucent layer, such that they preferably remain tangibly and visibly present at the final surface of the decorative top layer. When one or several protrusions are completely flattened out by means of the transparent or translucent layer, it is preferred that the built-up protrusions remain at least visibly present through the transparent or translucent layer. In this way, particular depth effects still can be achieved without a structure effect on the final surface. Such depth effects are less sensitive to wear, as they are embedded and are not present at the surface of the coated panel as projecting wear-sensitive portions.

It is noted that the above-mentioned transparent or translucent layer may comprise ingredients which protect the underlying print layers, such as hard particles which reduce possible wear or scratches, or ingredients which restrict the aging of the color of an underlying pattern, such as ingredients reducing the UV sensitivity of the pattern.

The method of the invention may be applied for manufacturing floor panels. In such case, it may be desirable to apply a transparent or translucent layer with hard particles, such as aluminum oxide or any other mineral.

It is clear that the method of the invention can be applied to any substrate and that, for example, the material of the substrate or the size thereof is not restricted. Concerning the material, use can be made of wood or wood-based materials, such as particle board or MDF or HDF (Medium Density Fiberboard or High Density Fiberboard). Of course, the substrate can be treated prior to the printing step. For example, the substrate may be provided with one or more primer layers, such as adherence layers, paper layers or so-called bottom shades. The bottom shades may form, for example, a uniform or not uniform background color of the pattern.

In general, the method of the invention may be performed on substrates showing already as much as possible the geometry of the final coated panel. In such case, namely, the stock of different semi-finished products may be reduced. Thus, the substrate approximately has its final size and shape when the prints are provided.

One or more of the prints or print layers may be performed with a colorant, such as ink or paint. In the case of ink, one may opt for a water-based ink as well as for an ink on solvent basis, wherein the water-based ink is preferable, as this leads to a more economic and environmentally friendly process.

According to an alternative, one or more of the prints or print layers may be performed with a transparent or translucent material, such as with a lacquer or a varnish.

The method of the invention may be applied for manufacturing coated panels, such as floor panels, with a decorative top layer representing a pattern, wherein the pattern is obtained substantially or exclusively by printing said substrate. By means of this embodiment, thus, the pattern as well as the structure of the panel may be obtained by a printing process applied on the substrate, as a consequence of which a very versatile process can be obtained. Of course, here, too, one may work with intermediate layers or material, such as primer layers.

It is clear that the present invention also relates to coated panels which are obtained or may be obtained by a method of the invention. Such panels, according to a portrait definition and independently of the method by which they are manufactured, can be defined as a coated panel of the type comprising at least a substrate and a decorative top layer provided on the substrate, with the characteristic that the decorative top layer comprises a structure of protrusions, wherein at least one of the protrusions consists of two or more prints or print layers provided on top of each other. To those skilled in the art, it is clear that the preferred embodiments mentioned in connection with the method of the invention lead to corresponding preferred structural features of the coated panel.

BRIEF DESCRIPTION OF THE DRAWINGS

With the intention of showing the characteristics of the invention, hereafter, as an example without any limitative character, several example, non-limiting embodiments are described, with reference to the appended drawings, wherein.

DESCRIPTION OF EXAMPLE, NON-LIMITING EMBODIMENTS

Figure 1:
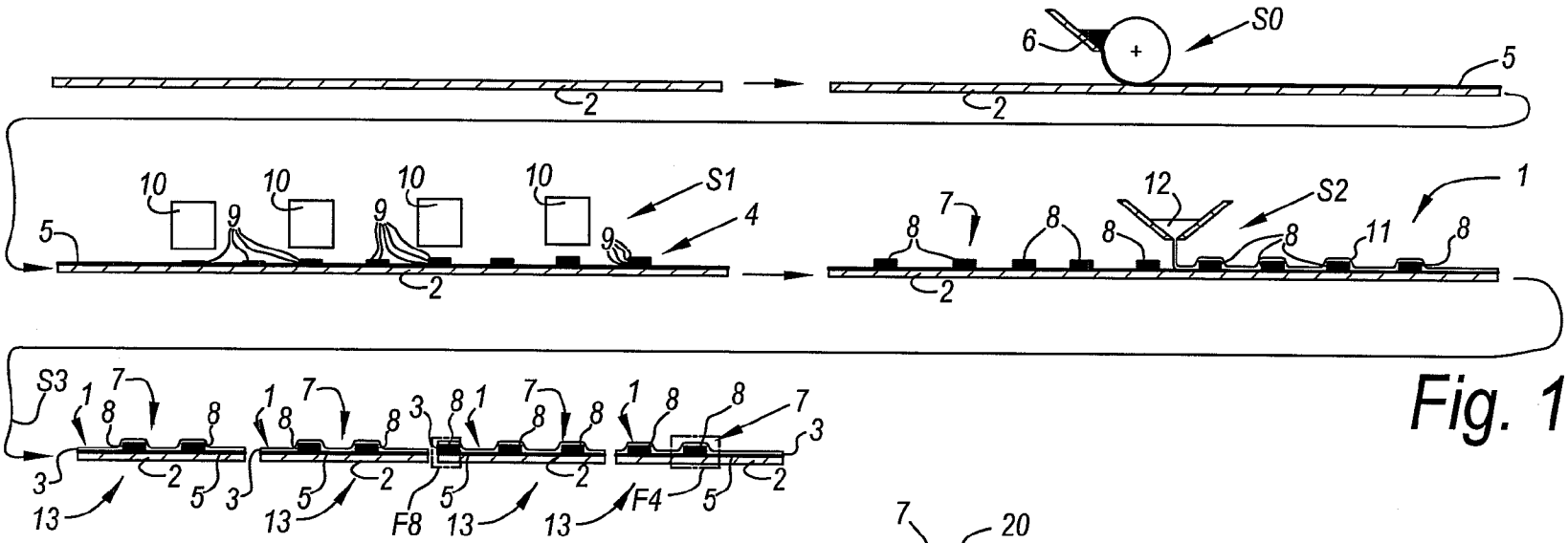
FIG. 1 is a schematic view of a method according to an embodiment of the invention.

FIG. 1 shows an example method for manufacturing a coated panel 1. Herein, one starts from a board-shaped substrate 2, on which a decorative top layer 3 is provided. For forming the top layer 3, the method involves at least a step S1 in which the substrate 2 is printed. The print 4 from step S1 represented here is performed indirectly on the substrate 2. In a preceding step S0, this substrate 2 then has been provided with one or more primer layers 5, such as uniform basic layers. Providing this basic layer or primer layer 5 in step S0 comprises, in this example, at least providing a substance 6, such as a lacquer, in liquid form. According to another possibility, the basic layer may also comprise solid layers, such as paper layers, or one may work without basic layer, such that in this latter case the print 4 is performed directly on the substrate 2.

The particularity of the method of the example consists in that during said step S1, in which the substrate 2 is printed, a structure 7 is realized on the substrate 2, wherein this structure 7 comprises protrusions 8 formed by two or more print layers 9 provided on top of each other. In the present case, each time more than three, namely four, prints or print layers 9 are provided on top of each other in order to form the protrusions 8. This is realized here by moving the board-shaped substrate 2 beneath several printing units 10. These printing units 10 may form part of the same or several printing devices. Preferably, use is made of digital printing devices 10, such as inkjet printing devices 10. Namely, those allow mutually attuning the separately applied print layers 9 in a simpler manner, more particularly in order to mutually attune the position of the printing layers 9. It is not excluded that other printing techniques than inkjet printing are applied. Thus, for example, it is possible to work with screen printing, offset printing and the like. Possibly, one may also work with a combination of printing techniques, which techniques each deposit one or more of the print layers 9 on the substrate 2.

In a step S2, which here is performed after the printing step S1 has been completed, a transparent layer 11 is provided on the board-shaped substrate 2, with which layer the print 4 is covered. Various techniques may be applied to this aim. As shown here, the transparent or translucent layer 11 is provided by means of a method in which at least a liquid substance 12 is provided on the substrate 2. For providing a liquid substance 12, various techniques may be applied, such as spraying techniques, pouring techniques, roller application techniques, and so on. It is not excluded that instead of working with a liquid substance, a solid or already solidified transparent or translucent layer 11 is used which is provided on the substrate 2. Thus, for example, one may work with a so-called overlay, which may consist of a material sheet provided with synthetic material, such as a paper layer soaked with melamine resin.

Although step S1 and S2 in the example are performed on larger boards, which then are divided in a successive treatment step S3, it is not excluded that, according to variants, the step S1 and/or the step S2 are performed on smaller panels 13, which, for example, already have substantially the dimensions of the final coated panels 1.

Although step S2 in the example is performed after step S1 has been completed, it is not excluded that, according to variants, a transparent or translucent layer 11 is used, which is provided in two or more partial steps, wherein at least one of these partial steps is performed before said printing step S1 is completed, for example, before applying at least one of said print layers 9.

It is noted that the transparent and/or translucent layer 11, which is provided in step S2 or in one or more partial steps of S2, does not necessarily have to cover the entire surface of the substrate 2 or the panel 1 obtained from it. Thus, for example, the translucent or transparent layer 11 may be provided in the spaces between one or more of the print layers 9 of the protrusions 8, which then already have or have not been provided on the substrate 2.

It is obvious that the coated panels 1 which have been obtained after step S3 possibly may undergo still further treatments, such as edge treatments. So, for example, in the case that floor panels are concerned, profiled edge portions comprising coupling means may be realized at the edges of these panels, by which the panels can be coupled to each other in order to form a floor covering. This may relate to coupling means in the form of a traditional tongue and groove connection, which then are glued together when installing the floor covering, or in the form of so-called glue-free mechanical connections, such as those known as such, for example, from WO 97/47834.

Figure 2:
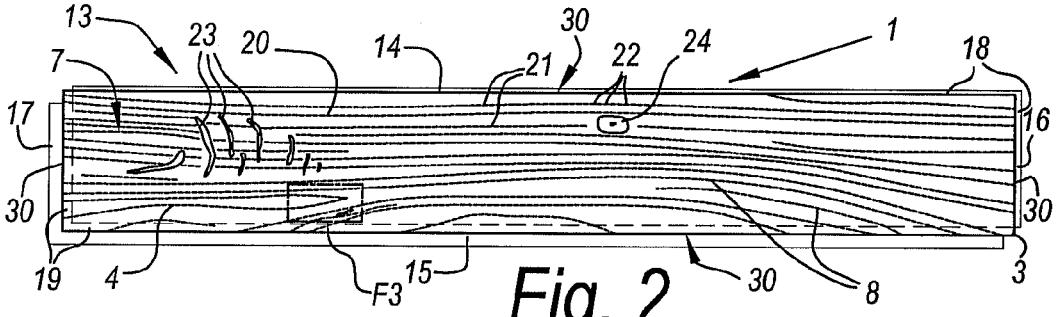
FIG. 2 is a plan view of a coated panel according to an embodiment the invention.

FIG. 2 shows a finished coated panel 1, in this case, a floor panel. Herein, this relates to an oblong floor panel, which both at the opposed long edges 14-15 and the opposed short edges 16-17 is provided with coupling means which substantially are made as a tongue 18 and a groove 19. At the upper side 20 or decorative side, the floor panel has a decorative top layer 3 obtained by means of a method according to the invention. In this case, this relates to a decorative top layer 3 representing a wood pattern. The structure 7 realized by means of the method relates to a wood structure. As is evident from FIG. 2, such wood pattern and/or wood structure may show elements such as wood nerves 21 and/or wood pores 22 and/or wood silver grains and/or wood knots 24 and the like. By means of the method of the present invention, one or more of the elements from the wood pattern may correspond to the wood structure, by which is meant that the protrusions 8 of the structure 7 are situated along or at the height of the corresponding portion of the pattern or follow this pattern.

It is clear that, when characteristic recesses have to be formed at the surface of the decorative top layer 3, such as it may be the case when imitating wood pores 22, the protrusions 8 of the structure 7 of the present invention then will leave just this wood pore blank and cover the surface next to this wood pore. According to the desired structure 7, the print layers 9 may cover a smaller or a larger surface of the substrate 2.

It is not excluded that the inventive technique for forming the structure 7 applied in the present method is combined with methods known from the prior art. Thus, for example, characteristic protrusions 8 can be formed by means of the technique of the invention, whereas recesses are formed by means of a technique from the prior art, for example, by impressing a translucent or translucent layer 11, which is provided on top of the print layers 9, with a mould, and/or by working with a repellant for this layer 11, which repellant then is provided on the locations where the recess is expected.

The wood pattern may be obtained in any manner. Preferably, this relates to a printed wood pattern, however, one may also work with a veneer layer or a cork layer. When the wood pattern is printed, this print 25 can have been provided beforehand on a material sheet, such as on a paper layer, or this print 25 may also, whether or not directly, be printed on the substrate 2, wherein printing the pattern then forms part of said step S1 in which the substrate 2 is printed. Thus, for example, in this step first a substantially flat print 25 can be obtained, which represents the wood pattern or a portion thereof, after which the print layers 9, which form the protrusions 8, are provided, or the print 25 of the pattern can be provided after already at least one or even all print layers 9 forming the protrusions 8 have been applied.

Figure 3:
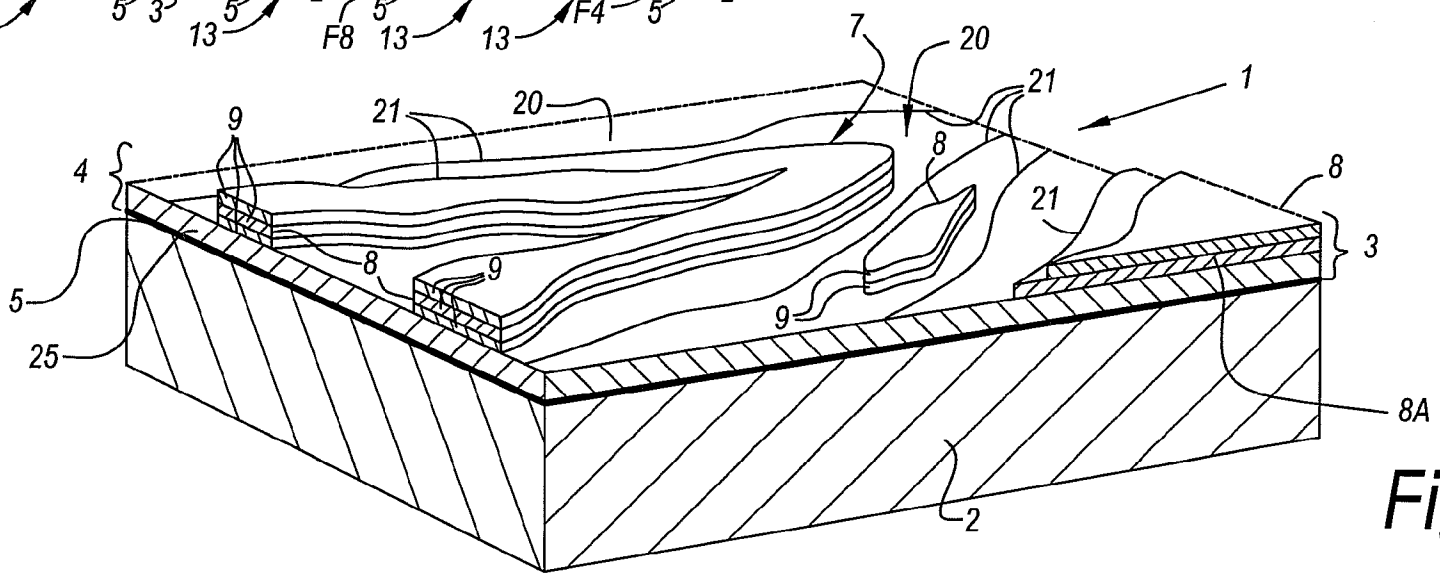
FIG. 3, is an enlarged perspective view of the area indicated by F3 in FIG. 2.

FIG. 3 represents an example, wherein some wood nerves 21 are provided with a relief by providing each time two or more print layers 9 on top of each other. These are provided on a substrate 2, which is provided with a primer layer 5 and subsequently is printed with a wood pattern. The example from FIG. 3 further also clearly shows that the structure 7 is provided in correspondence with the wood pattern and that the protrusions 8-8A which are present in the structure 7 may comprise a varying number of print layers 9. Also, by means of the protrusion 8A situated at the right hand side below, it is shown that the different print layers 9 forming one and the same protrusion 8A do not necessarily have to overlap each other completely. In this manner, truly three-dimensional protrusions 8A can be constructed.

It is noted that in FIG. 3, for the sake of the simplicity of the representation, the possible translucent or transparent layer 11 which can be provided over such panel 1 or substrate 2 is not shown here.

Figure 4:
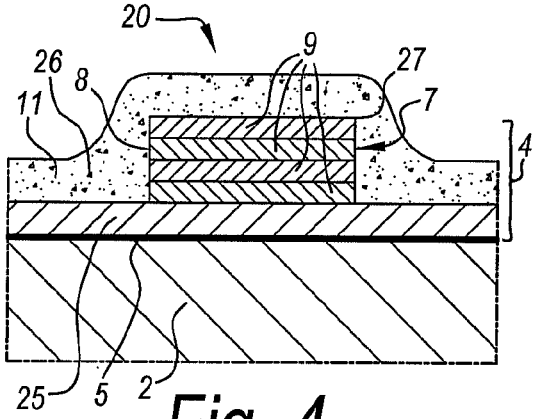
FIG. 4, is an enlarged sectional view of the area indicated by F4 in FIG. 1.

FIG. 4 shows an embodiment wherein a protrusion 8 is formed by four substantially identical print layers 9, above which a transparent or translucent layer 11 with hard particles 26 is provided. According to the thickness of the translucent layer 11, the formed protrusion 8 remains tangibly present to a greater or lesser extent. The thinner this layer 11 is provided above the protrusion 8, the simpler is it to maintain the sharp edges 27 of the structure 7 present at the surface of the coated panel 1, too. Preferably, the thickness of the transparent or translucent layer 11 is smaller than the thickness or still better smaller than half of the thickness of the protrusion 8.

Figure 5:
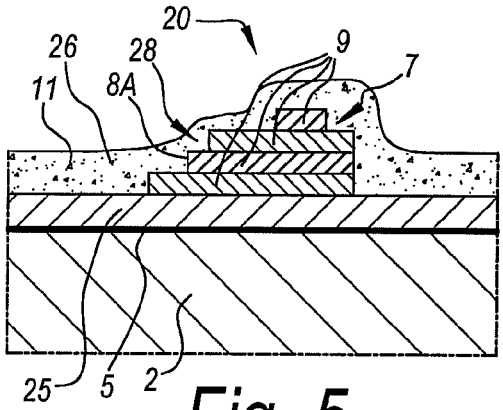
FIGS. 5 to 7, in a similar view as FIG. 4, represent variants.

FIG. 5 shows an embodiment, wherein a protrusion 8A is formed by four print layers 9 situated on top of each other and having a different cross-section, as a result of which this protrusion 8A, which is built up in layers, shows at least one inclined or curved wall 28. In the case of FIG. 5, the cross-section of the print layers 9 decreases from the substrate 2 towards the surface of the decorative top layer 3.

The possibility of realizing inclined or curved walls 28 renders the technique of the invention also very suitable for realizing edge characteristics, such as deepened edges, for example, in the form of a bevel or chamfer.

The technique of the invention also allows realizing other edge characteristics, such as imitations of joints, cement joints and gaps. Also, it is possible to realize the already mentioned edge characteristics, such as chamfers, within the decorative top layer 3 of the substrate 2 and/or the final coated panels 1. Thus, for example, it is possible to imitate so-called multiplanks by means of the technique of the invention in an advantageous manner. The multiplanks represent several parallel rows of wood planks on the same coated panel 1. Between the wood planks then a gap or chamfer can be realized in the aforementioned manner.

Figure 6:
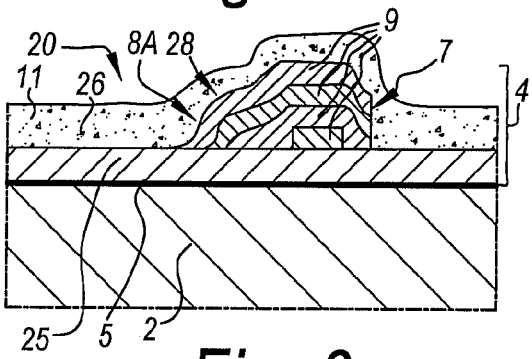

FIG. 6 shows with a variant that the print layers 9 not necessarily have to decrease in cross-section, such as in FIG. 5. In FIG. 6, print layers 9 are applied having cross-sections increasing from the substrate 2 towards the surface of the decorative top layer 3. This variant allows a larger tolerance in respect to the correspondence of the positions of the different print layers 9, as a small deviation in an underlying print layer 9 is concealed by a larger print layer 9 provided on top thereof.

Figure 7:
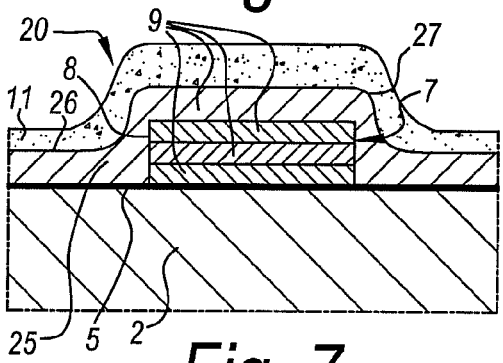

FIG. 7 shows another variant, in which the print 25 of the actual pattern of the decorative top layer 3 is provided after the structure 7 of protrusions 8 has been printed. In this case, this relates to a pattern printed on the substrate 2, which pattern also is printed over the already formed structure 7. By this is obtained that the layer structure of the protrusions 8-8A is concealed. Of course, instead of printing over the protrusions 8-8A, it is also possible to print the print 25 of the actual pattern in between the protrusions 8-8A and/or that the protrusions 8-8A themselves are an integral part of the pattern. A combination of both printing methods for the pattern is possible, too.

Figure 8:
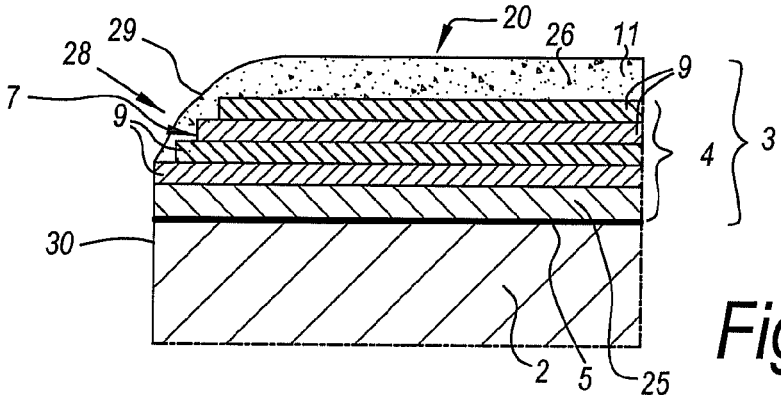
FIG. 8 is an enlarged sectional view of the area indicated by F8 in FIG. 1.

FIG. 8 represents an example of the realization of an edge characteristic 29 by means of a method of the invention. In this case, this concerns a rounded bevel at the edge 30 of the coated panel 1.

It is clear that the variants presented by means of the FIGS. 3 through 8 can be applied in the same coated panel 1. It is also clear that in the case of the embodiments of FIGS. 3 to 6 and 8, at least the uppermost print layer 9 of the respective protrusion 8-8A preferably has a decorative aspect, for example, is formed by means of a colorant. It is possible that the uppermost print layer 9, for example, in the case of FIG. 8, as such shows a pattern, such as a wood pattern. However, it is also possible that the print layers 9 forming the protrusions 8-8A are transparent or translucent and therefore have little or no influence upon the visibility of underlying layers, such as underlying prints. Such underlying print may be formed by the print 25 of the actual pattern.

It is noted that the thickness of the layers and/or prints represented in the figures is shown schematically and/or exaggerated. Also, the mutual relations between these layers are shown randomly and do not contain a restriction in respect to possible embodiments or the materials applied in these layers or prints. It is clear that in general the total thickness of the decorative top layer 3 may be less than 2 millimeters and even less than 1 millimeter, whereas the substrate 2, upon which the decorative top layer 3 is provided, may vary in thickness, for example, between 5 and 15 or even up to 25 millimeters.

Further, it is noted that the entire print 4 comprises the possible print 25 of the wood pattern as well as the print layers 9 provided on top of each other. It is also noted that the print layers 9 provided on top of each other, which form the protrusions 8-8A, do not necessarily have to be in direct mutual contact. Possibly, intermediate materials may be applied, such as materials promoting the mutual adherence of the various print layers 9 on each other.

It is clear that the decorative top layer 3 consists of all layers or other material situated on top of the substrate 2. It is also clear that the protrusions 8-8A do not necessarily form a structure which is present at the surface of the final coated panel 1. In fact, it is the print 4 itself, and in particular the print layers 9 provided on top of each other, which shows the structure 7. Such structure 7 in fact may be partially or even entirely flattened out by layers situated on top thereof, such as a transparent or translucent layer 11. Preferably, such structure 7 indeed results in a structure which is present at the surface of the final coated panel 1, 13.

It will be understood that the details of the example embodiments are shown by way of illustration only and not as limitations of the invention. The principles and features of this invention may be employed in varied and numerous embodiments without deviating from the scope of the invention.

What is claimed is:

1. A method for manufacturing a coated panel having at least a substrate and a decorative top layer provided on the substrate, the method comprising:

providing the substrate having a print layer with a pattern;

applying a plurality of prints on the substrate to form at least a portion of the top layer, such that the plurality of prints form a structure on the substrate that includes at least one protrusion formed by two or more prints provided on top of each other;

wherein each of the two or more prints provided on top of each other includes a colorant;

wherein the print layer forms a continuous layer underlying a plurality of the protrusions; and providing a transparent layer or a translucent layer on top of the plurality of prints.

2. The method of claim 1, wherein the two or more prints provided on top of each other, in a cross-section of the protrusion, have an identical pattern.

3. The method of claim 1, wherein the two or more prints provided on top of each other, in a cross-section of the protrusion, have different patterns, and wherein the print provided on top has a smaller printed surface.

4. The method of claim 1, wherein the two or more prints provided on top of each other are made of the same material.

5. The method of claim 1 applied for manufacturing a panel with a decorative top layer representing a wood pattern, wherein the structure relates to a wood structure.

6. The method of claim 5, wherein the wood structure corresponds to an underlying printed wood pattern.

7. The method of claim 1, further comprising:

using one or more digitally controlled inkjet printing units to apply the plurality of prints on the substrate.

8. The method of claim 1 applied for manufacturing a floor panel.

9. The method of claim 8, wherein the substrate has approximately its final size and shape when said prints are applied.

10. The method of claim 1, wherein at least one of the prints is performed with a water-based ink or an ink on solvent basis.

11. The method of claim 1, wherein at least one of the prints is performed with a transparent material or a translucent material.

12. The method of claim 1, wherein the decorative top layer represents a pattern, and wherein the pattern is exclusively obtained by printing the substrate.

13. A method for manufacturing a panel having a substrate and a decorative top layer provided on the substrate, the method comprising:

providing the substrate having a print layer with a pattern;

applying a first print on the substrate;

subsequently applying a second print on the substrate, such that at least a portion of the second print is provided on top of the first print to form a protrusion on the print layer;

wherein the first and the second prints form at least a portion of the decorative top layer;

wherein each of the first print and the second print includes a colorant; and providing a transparent layer or a translucent layer on top of the first and the second prints.

* * * * *